US009592988B1

(12) United States Patent
Herrmann

(10) Patent No.: US 9,592,988 B1
(45) Date of Patent: Mar. 14, 2017

(54) FLOATING ON STACK COMPILING AND REGISTRATION CLAMP SYSTEM

(71) Applicant: XEROX CORPORATION, Norwalk, CT (US)

(72) Inventor: Douglas K Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/972,279

(22) Filed: Dec. 17, 2015

(51) Int. Cl.

| | |
|---|---|
| ***B65H 31/26*** | (2006.01) |
| ***B65H 29/18*** | (2006.01) |
| ***B65H 31/10*** | (2006.01) |
| ***G03G 15/00*** | (2006.01) |

(52) U.S. Cl.
CPC ..... *B65H 31/26* (2013.01); *B65H 29/18* (2013.01); *B65H 31/10* (2013.01); *G03G 15/6561* (2013.01); *B65H 2404/696* (2013.01); *B65H 2404/6942* (2013.01); *B65H 2801/12* (2013.01)

(58) Field of Classification Search
CPC ..... B65H 9/08; B65H 31/02; B65H 31/26; B65H 31/36
USPC ..... 271/220, 224
See application file for complete search history.

(56) References Cited

U.S. PATENT DOCUMENTS

| | | | |
|---|---|---|---|
| 6,091,929 | A | 7/2000 | Yamazaki et al. |
| 8,950,748 | B1 | 2/2015 | Herrmann et al. |

*Primary Examiner* — David H Bollinger

(57) ABSTRACT

A floating clamp mechanism prevents sheets from migrating back from a lead edge registration wall during the compiling of sheets in a stacker. The floating clamp mechanism includes a spring loaded ball mounted in converging upper and lower tracks that act as a one-way clutch. This allows the incoming sheets to be scuffed with low force to the lead edge registration wall while simultaneously holding the registered sheets to the registration wall.

17 Claims, 4 Drawing Sheets

FLOATING ON STACK COMPILING AND REGISTRATION CLAMP SYSTEM

This invention relates in general to an image forming apparatus, and more particularly, to an image forming apparatus employing an improved scuffing registration system.

Typically, in an electrophotographic printing process of printers, such as, U.S. Pat. No. 6,091,929, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to the donor roll is then deposited on latent electrostatic images on a charge retentive surface, which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

A finisher is usually arranged in a post processing position to receive the fused copy substrates or sheets and staple them, if desired. In many such finishing, tamping systems are commonly used to register the sheets in compiler trays. Sheets are usually scuffed against a lead edge (LE) registration wall of the compiler trays for various post finisher functions, such as, hole punching, corner stapling, edge stapling, sheet and set stacking, letter or tri-folding, Z-folding, Bi-folding, signature booklet making, set binding, trimming, post process sheet insertion, saddle stitching and others.

After sheets are conveyed onto a compiling shelf they are scuffed to the lead edge registration wall and need to then be tamped by inboard and outboard tampers to complete cross process registration. A current system incorporates an articulating scuffer that lifts the scuffer to allow the side tampers to register the sheets in the cross process direction. Unfortunately, when the scuffer is lifted the sheets that have been scuffed and had their LE registered against the registration wall can migrate back in the process direction when the scuffing force is not present due to the fact that the trail edges (TE) of the sheets are lower than the LE shelf on which they are positioned based on the architecture that has the media being compiled directly on a stack of media sets. The stack is approximately 7 mm below the LE shelf.

Problems occur in keeping the sets from migrating away from the registration wall either when the scuffer is lifted for engagement of the side tamping function and the sheets consistently migrate away from the registration wall or simply due to the speed and angle in which sheets contact a registration wall. This impacts the inset registration which needs to be especially tight for stapled sets.

Also, registration issues are caused by the need to engage and disengage the scuffer during compiling to allow for side tamping of the compiled set. The scuffer is used to drive the individual sheets against the registration wall but the drive forces/frictional load of the scuffer cannot be overcome by the side tampers to allow side tamping/registration. To accommodate side registration, the scuffer must be lifted to allow for the sheets to be tamped from the side.

Unfortunately, as soon as the scuffer is lifted, the sheets migrate away from the LE registration wall. This results from the fact that the TE of the sheets are lower than the LE of the sheets and the sheets drift down and back away from the LE registration wall. This situation becomes worse as the stack becomes more uneven due to curl and staple build up leading to an increase in the height difference from the LE shelf and the top of the stack.

U.S. Pat. No. 8,950,748 B1 addresses the above-mentioned problems when compiling a small set of sheets onto a fixed shelf where they are then ejected to a sheet stack once each set is compiled and includes a self-adjusting clamp mechanism that prevents sheets from migrating back during the compiling of sheets in a stacker with a fixed shelf. The mechanism consists of a spring-loaded ball bearing in a converging track placed just before a registration wall. The sheets are scuffed under the ball bearing and against the registration wall. The track converges away from the registration wall such that it allows sheets to enter freely against the registration wall, exerting little resistance for side tamping and preventing the sheet from moving away from the registration wall as the ball bearing is driven tighter into the converging track.

However, there is still a need for an improved compiling and registration finishing apparatus and method that allows the building of incoming sheet or sheet sets directly onto a sheet stack. When using a compiling shelf and then an eject process it allows for a rigid platform or shelf to contain the ball bearing in U.S. Pat. No. 8,950,748 B1, whereas stacking directly on the stack takes away this ability since the sheet stack has to be lowered and removed.

Accordingly, an improved self-adjusting clamping mechanism is disclosed that prevents media from migrating back during the compiling of media loaded directly into a stacker. The self-adjusting mechanism includes spring-loaded ball bearing mounted in a floating converging upper and lower track attached to a vertically movable registration wall and acts as one-way clutch. This allows the incoming media to be scuffed with low force to the lead edge registration wall while simultaneously holding the registered media to the registration wall regardless as to media stack height and unevenness of the top surface of the media stack. Alternatively, the spring could be eliminated, if desired.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
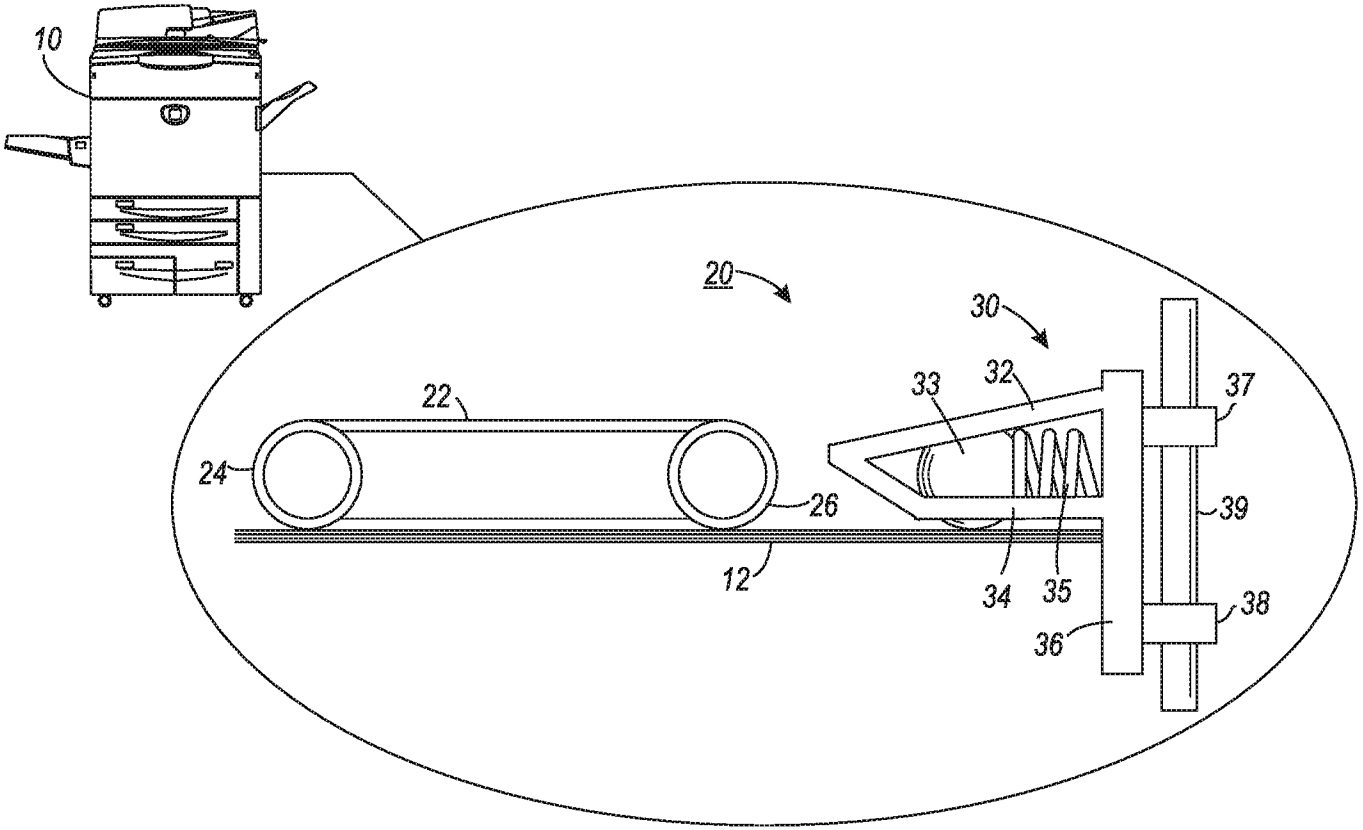
FIG. 1 is a partial schematic side view of a compiler with a floating clamping mechanism in accordance with the present disclosure during compiling.
Figure 2:
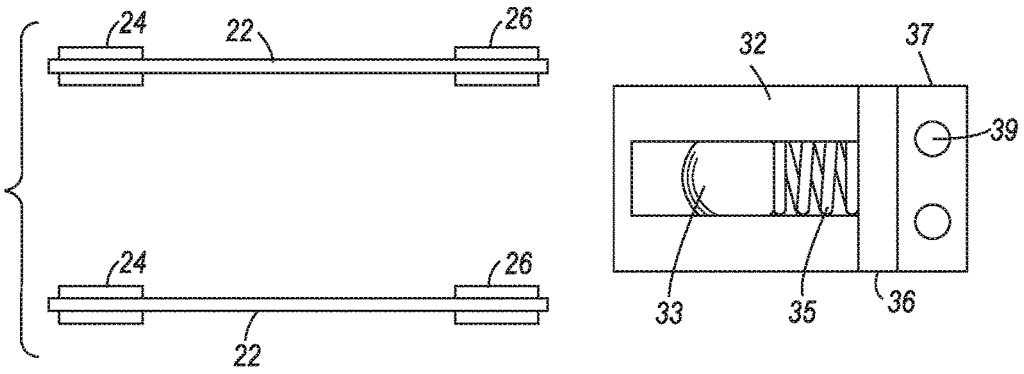
FIG. 2 is a partial schematic top view of the floating clamping mechanism apparatus of the present disclosure showing a single clamping mechanism.

In FIGS. 1 and 2, a conventional electrostatographic printer apparatus 10 includes a compiler 20 that compiles sheets in accordance with the present disclosure and comprises a self-adjusting clamping mechanism 30 for the LE of the sheets that: allows each sheet to be freely scuffed against a LE wall 36; allows the sheets to be side tamped with low resistance; and simultaneously clamps the sheet(s) and prevents motion in the reverse process direction—even after scuffer belts 22 of a conventional scuffer mechanism is lifted for side tamping.

Compiler 20 includes media or sheets 12 conveyed by belts 22 rotatably mounted on idler roller 24 and drive roller 26. Sheets 12 are driven for registration against registration wall 36. A clamping mechanism 30 is included that comprises a spring 35 that loads a ball bearing 33 with both enclosed in converging track that includes a member 34 having a horizontal portion and another portion that slants away from one end of the horizontal portion, and a member 32 that is slanted toward and converges with the slanted end of member 34 which together acts as a one-way clutch. This allows the incoming media to be scuffed with low force to lead edge registration wall 36 and allows side to side tamping, but simultaneously limits any paper motion in the upstream process direction. The converging track can be angled up towards the registration wall to the extent that the angle allows gravity to provide the force components need to keep the ball bearing in contact with the top of a sheet stack. Track members 34 and 32 allow the sheet stack to be lowered and to be removed while still having the registration clamp 30 contained. Since ball bearing 33 is loaded by spring 35, the ball clamp allows ease of movement when it is pushed in the diverging direction of the enclosed track but if the media is "pulled" back the ball is forced in the diverging direction and puts a high locking force on the media set which creates a self-adjusting clamping force as each sheet is added to the set being compiled. Ball 33 is free to rotate in all directions except when it is rotated clockwise (from the operator side) when the media attempts to migrate away from wall 36. This is accomplished by placing the ball in the converging track that drives ball bearing 33 tighter as the media attempts to rotate the ball clockwise. Compression spring 35 is applied to the ball to set an initial loading that helps to limit the travel of the ball and limits the ability of the media to move away from the LE registration wall 36. Registration wall 36 is connected to supports 37 and 38 and floated up and down rods 39 by conventional mechanisms, such as, rack and pinion, helical screws, etc., in response to a conventional sensor sensing changes in stack height. As a stack of sheets or media 12 continues to grow, a tray (not shown) lowers to maintain the stack height. Simultaneously, registration wall 36 and ball clamping mechanism 30 floats to handle the stack contour due to curl or cockle effects on the flatness of the top of the stack. Registration wall 36 and ball clamping mechanism 30 also handles stack tray movement, i.e., the tray lowers based on a sensor detecting the top of the stack but the stacker tray will always have a modicum of over travel as it drops.

Compression spring 35 is used to both: apply a setting force in a horizontal direction; and to keep ball bearing 33 seated against the angled track/guide comprised of walls 32 and 34 that enclose ball 33 therebetween. This ensures that each incoming sheet will rotate ball bearing 33 away from the converging guide while also ensuring minimal movement of the ball away from the converging guide. This allows the ball to lock and create a high force down against the compiled set. As the set continues to build ball bearing 33 incrementally shifts towards the registration wall to accommodate more sheets while continuing to provide the necessary clamping function. If desired, spring 35 could be removed from between walls 32 and 34 with ball bearing 33 allowed to move freely towards and away from registration wall 36. The entire system is released through conventional means during eject allowing the newly compiled/stapled set to be ejected from the compiler apparatus.

Figure 3:
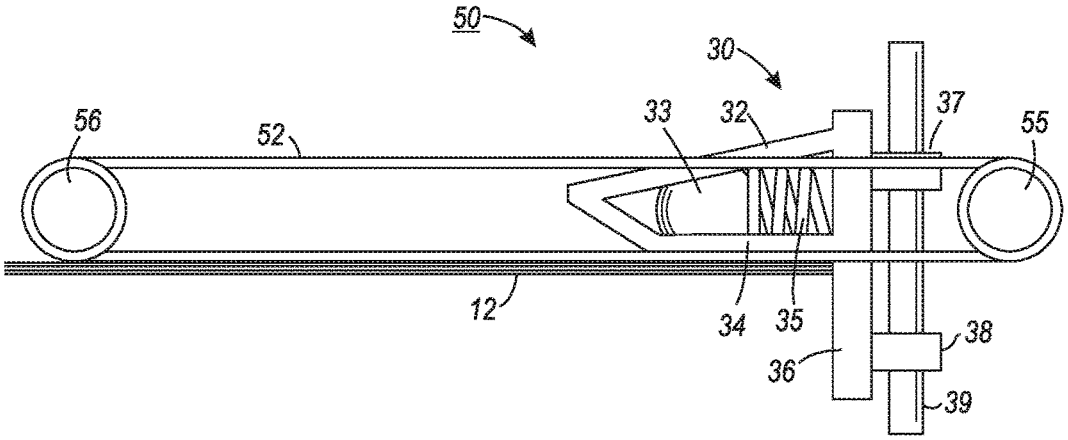
FIG. 3 is a partial schematic side view of an alternative compiler with the floating clamping mechanism of the present disclosure showing a longer scuffer drive system with an upstream clamping mechanism.
Figure 4:
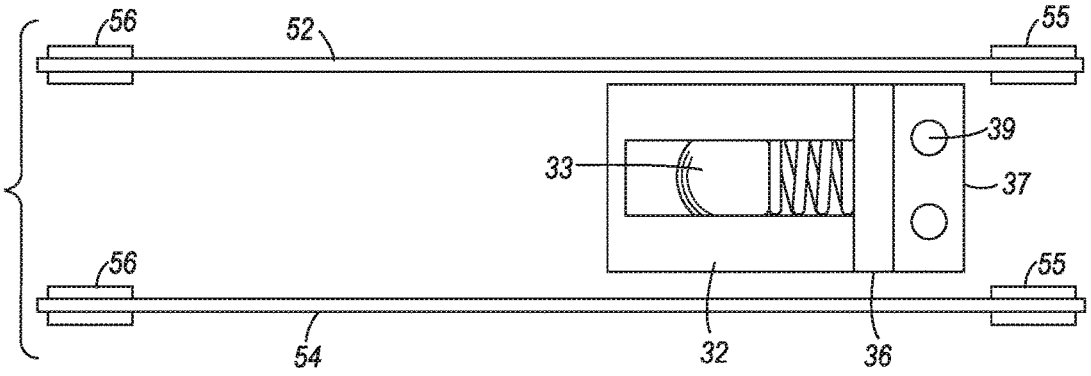
FIG. 4 is a partial schematic top view of the alternative floating clamping mechanism of FIG. 3 showing a single clamping mechanism.

An alternative embodiment of the present disclosure includes a compiler 50 shown in FIGS. 3 and 4 that is identical to the embodiment of FIGS. 1 and 2 except that scuffer belts 52 and 54 mounted on drive roller 55 and idler roller 56 are longer and the registration system is positioned upstream of drive rollers 55.

Figure 5:
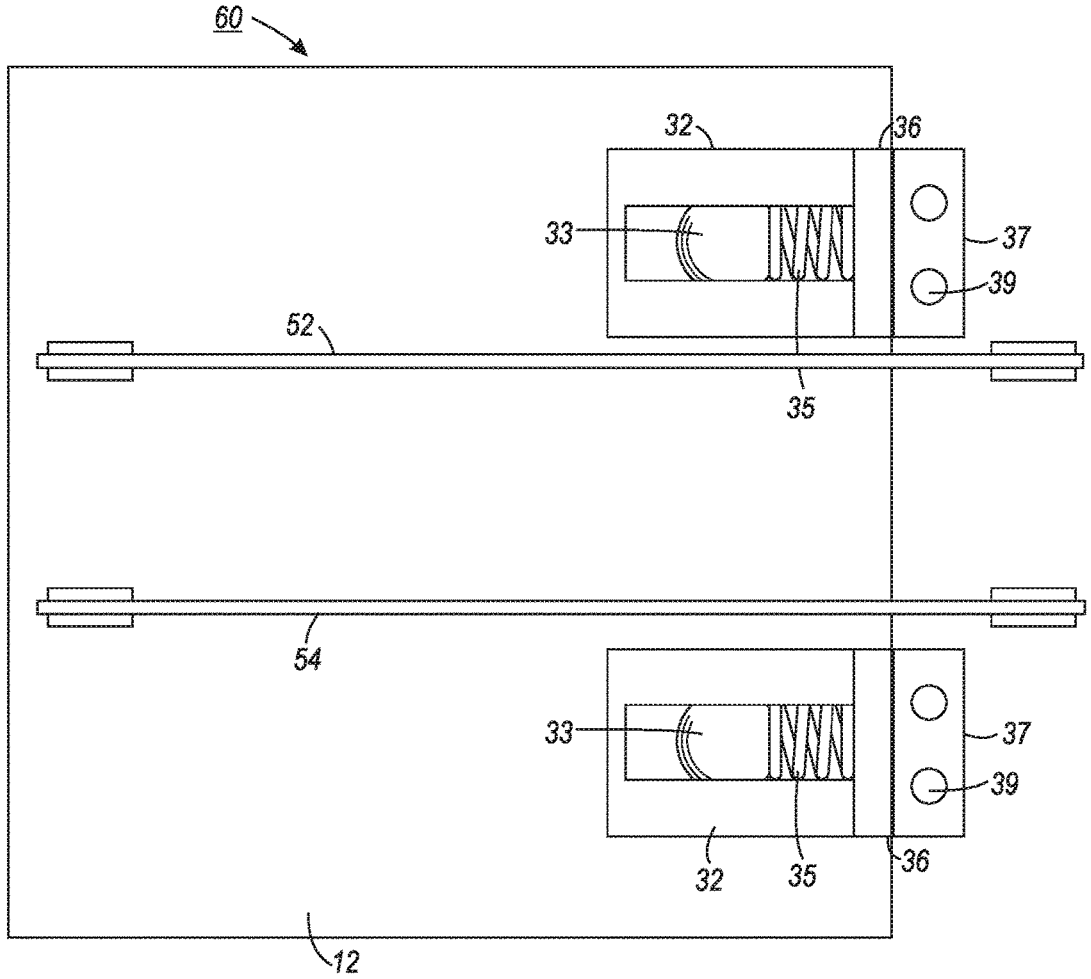
FIG. 5 is a partial schematic top view of the alternative floating clamping mechanism of FIG. 3 showing dual clamping mechanisms.

Another alternative embodiment compiler 60 of the present disclosure is shown in FIG. 5 that is identical to the embodiment of FIGS. 3 and 4 except that an additional clamping mechanism is employed to register media against registration wall 36 of self-adjusting and floating clamping mechanism 30. The floating clamping mechanisms are positioned outside scuffer belts 52 and 54.

Figure 6:
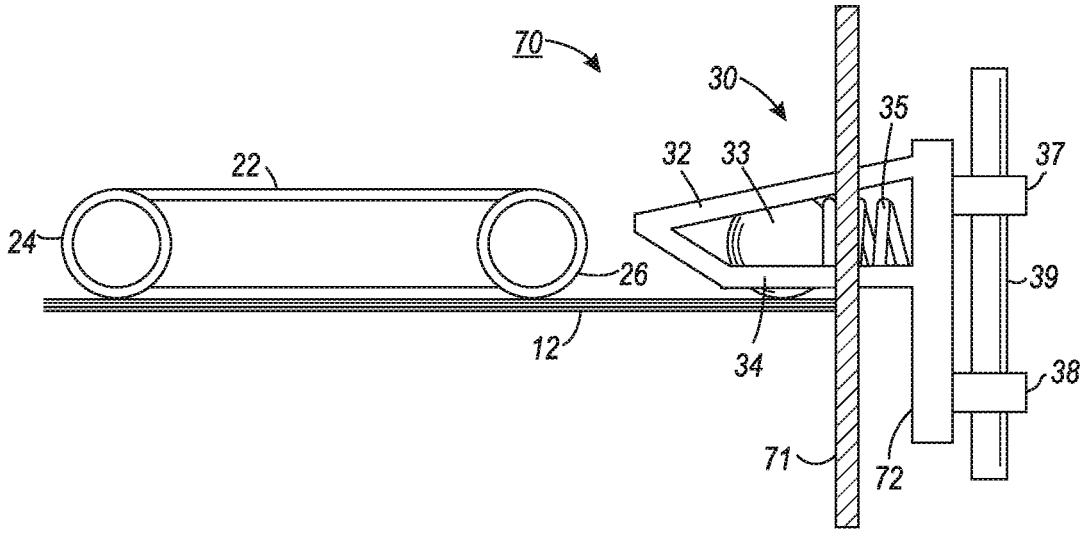
FIG. 6 is a partial schematic side view of a compiler with a floating clamping mechanism in accordance with the present disclosure in which a fixed registration wall is employed.
Figure 7:
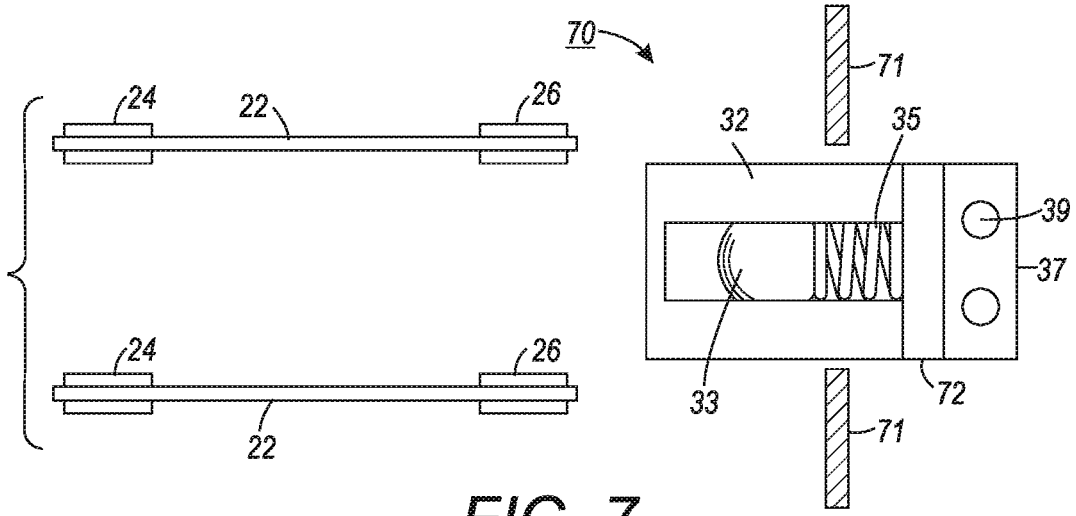
FIG. 7 is a partial schematic top view of the compiler with a floating clamping mechanism of FIG. 6 showing positioning of the compiler between portions of the fixed registration wall.

In yet another alternative embodiment in FIG. 6, a compiler 70 shown in that is identical to the embodiment of FIGS. 1 and 2 except that the clamping mechanism 30 is not attached to registration wall 71, but instead is attached to a floating support 72. It can be seen in FIG. 7 that clamping mechanism 30 is positioned to float up and down on top of a sheet stack between portions of fixed registration wall 71 in order to maintain its initial positioning beginning with the first sheet 12 to inter the compiler and throughout the conveying of sheets to be stacked.

It should now be understood that a floating clamping mechanism to be used in a media set compiling apparatus has been disclosed that relies on the use of a ball that is free to rotate in all directions except when the ball is rotated clockwise when the media attempts to migrate away from a LE registration wall. The ball is placed into a closed converging track that drives the ball tighter as the media attempts to rotate the ball clockwise. A compression spring is applied to the ball to set an initial loading that helps to limit the travel of the ball and limits the ability of the media to move away from the LE registration wall. Advantages of the floating clamping mechanism include: using a ball trapped between converging upper and lower tracks to allow scuffing and side tamping while simultaneously providing a registration wall and clamping mechanism that floats with the rise of sheets in a stack.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A compiling apparatus, comprising:

a registration wall for registering media thereagainst;

a scuffer mechanism for scuffing said media against said registration wall; and a registration system including a self-adjusting clamp mechanism that prevents said media from migrating back from said registration wall during compiling of said media in said compiling apparatus, said self-adjusting clamp mechanism including a spring-loaded ball bearing enclosed within a converging track between upper and lower walls that are connected to said registration wall, and wherein said upper wall of said converging track is slanted away from said registration wall and said lower wall has a first portion that is in a horizontal plane and a second portion that is slanted up and away from said first portion and converges with an end of said upper wall such that their convergence allows said media to enter freely against said registration wall while simultaneously preventing said media from moving away from said registration wall as said spring-loaded ball bearing is driven tighter into said converging track.

2. The compiling apparatus of claim 1, including multiple self-adjusting clamp mechanisms.

3. The compiling apparatus of claim 1, wherein said scuffer mechanism includes a pair of belts supported by drive and idler rollers, and wherein said registration system is positioned between and upstream of a portion of one end said pair of belts.

4. The compiling apparatus of claim 3, wherein said registration system includes dual self-adjusting clamp mechanisms.

5. The compiling apparatus of claim 4, wherein said pair of belts of said scuffer mechanism is positioned between said dual self-adjusting clamp mechanisms.

6. The compiling apparatus of claim 1, wherein said registration system is incorporated into a xerographic device.

7. The compiling apparatus of claim 1, wherein said self-adjusting clamp mechanism is adapted to accommodate multiple media sets.

8. The compiling apparatus of claim 1, wherein said self-adjusting clamp mechanism is positioned downstream of said scuffer mechanism.

9. The compiling apparatus of claim 1, wherein said scuffer mechanism includes a pair of belts supported by drive and idler rollers, and wherein an end portion of said pair of belts extends past said registration system.

10. A printer including a compiling apparatus for compiling individual sheets or sets of sheets with said compiling apparatus comprising:

a registration wall for registering sheets thereagainst;

a scuffer mechanism for scuffing said sheets against said registration wall; and a registration system including a self-adjusting clamp mechanism that prevents said sheets from migrating back from said registration wall during compiling of said sheets in said compiling apparatus, said self-adjusting clamp mechanism including a ball bearing enclosed within a converging track between upper and lower walls, and wherein said upper wall of said converging track is slanted down and away from said registration wall and said lower wall has a first portion that is in a horizontal plane and a second portion that is slanted up and away from said first portion and converges with an end of said upper wall that slants away from said registration wall such that their convergence allows said media to enter freely against said registration wall while simultaneously preventing said media from moving away from said registration wall as said ball bearing is driven tighter into said converging track.

11. The printer of claim 10, including multiple self-adjusting clamp mechanisms.

12. The printer of claim 10, wherein said scuffer mechanism includes a pair of belts supported by drive and idler rollers, and wherein said registration system is positioned between and upstream of a portion of one end said pair of belts.

13. The printer of claim 10, wherein said registration system is incorporated into a xerographic device.

14. The printer of claim 10, wherein said self-adjusting clamp mechanism includes a ball bearing and a spring bias positioned to bias said ball bearing towards a converging point of said converging track between said upper and lower walls.

15. A method for compiling sheets, comprising:

providing a registration wall for registering media thereagainst;

providing a scuffer mechanism for scuffing said media against said registration wall; and providing a registration system including a floating clamp mechanism that prevents said media from migrating back from said registration wall during compiling of said media in said compiling apparatus, said floating clamp mechanism including a spring-loaded ball bearing enclosed within a converging track between upper and lower walls with at least one of said upper and lower walls connected to said registration wall, including slanting said upper wall of said converging track away from said registration wall and providing said lower wall with a first portion that is in a horizontal plane and a second portion that is slanted up and away from said first portion and converges with an end of said upper wall such that their convergence allows said media to enter freely against said registration wall while simultaneously preventing said media from moving away from said registration wall as said spring-loaded ball bearing is driven tighter into said converging track.

16. The method of claim 15, including providing multiple floating clamp mechanisms.

17. The method of claim 15, including floating said clamp mechanisms vertically to accommodate variable media stack heights.

* * * * *